US012564751B2

(12) United States Patent
Im

(10) Patent No.: US 12,564,751 B2
(45) Date of Patent: Mar. 3, 2026

(54) COLLAPSIBLE MULTIPURPOSE EXERCISE EQUIPMENT

(71) Applicant: BODYNOX INTERNATIONAL CORP., Seoul (KR)

(72) Inventor: Youngho Im, Seoul (KR)

(73) Assignee: BODYNOX INTERNATIONAL CORP., Seoul (KR)

( * ) Notice: Subject to any disclaimer, the term of this patent is extended or adjusted under 35 U.S.C. 154(b) by 133 days.

(21) Appl. No.: 18/290,519

(22) PCT Filed: Jun. 26, 2023

(86) PCT No.: PCT/KR2023/008800

§ 371 (c)(1),
(2) Date: Nov. 14, 2023

(87) PCT Pub. No.: WO2024/005467

PCT Pub. Date: Jan. 4, 2024

(65) Prior Publication Data

US 2025/0082978 A1 Mar. 13, 2025

(30) Foreign Application Priority Data

Jun. 29, 2022 (KR) ..... 20-2022-0001593
Apr. 26, 2023 (KR) ..... 10-2023-0054634

(51) Int. Cl.
*A63B 17/04* (2006.01)
*A63B 22/00* (2006.01)

(52) U.S. Cl.
CPC ..... *A63B 17/04* (2013.01); *A63B 22/0087* (2013.01); *A63B 2210/50* (2013.01); *A63B 2225/12* (2013.01)

(58) Field of Classification Search
CPC . A63B 17/04; A63B 2210/50; A63B 2225/12; A63B 21/00; A63B 21/02;
(Continued)

(56) References Cited

U.S. PATENT DOCUMENTS 7,537,554 B2 * 5/2009 Zhuang ..... A63B 21/04 482/121
7,833,139 B1 * 11/2010 Endelman ..... A63B 21/4045 482/123

(Continued)

FOREIGN PATENT DOCUMENTS

BR 102022005955 A2 * 10/2022 ..... A63B 21/023
CN 213491738 U 6/2021

(Continued)

*Primary Examiner* — Nyca T Nguyen
(74) *Attorney, Agent, or Firm* — Bridgeway IP Law Group, PLLC; Jihun Kim

(57) ABSTRACT

The exercise equipment may include a first body unit 110 or 110' which includes: a first frame 211*a* and a second frame 211*b* disposed vertically to the surface and parallel to each other, a third frame 212*a* and a fourth frame 212*b* connecting the first frame 211*a* to the second frame 211*b*, a first connecting frame 214*a* connected to the third frame 212*a*, and a second connecting frame 214*b* connected to the fourth frame 212*b*; and a second body unit 120 or 120' which includes: a border frame 311 including connection shafts 313*a* and 313*b* inserted into a first hole formed in the first connecting frame 214*a* and a second hole formed in the second connecting frame 214*b*, and cushion units 321, 322 and 323 or 381, 382, 383*a* and 383*b* which are arranged on one side of the border frame 311.

3 Claims, 17 Drawing Sheets

(58) Field of Classification Search
CPC ..... A63B 21/06; A63B 21/4033; A63B 71/00; A63B 22/00; A63B 22/0076–0089; A63B 22/20–208; A63B 23/02–0244
See application file for complete search history.

(56) References Cited

U.S. PATENT DOCUMENTS

| | | | | |
|---|---|---|---|---|
| 7,878,954 | B2 * | 2/2011 | McBride | A63B 21/023 482/121 |
| 7,967,736 | B2 * | 6/2011 | D'Silva | A63B 21/00 482/121 |
| 9,744,400 | B2 * | 8/2017 | Cole | A63B 21/4035 |
| 12,179,056 | B2 * | 12/2024 | Wuttke | A63B 21/068 |
| 2004/0176227 | A1 * | 9/2004 | Endelman | A63B 22/203 482/142 |
| 2008/0171643 | A1 * | 7/2008 | Baudhuin | A63B 22/0087 482/148 |
| 2008/0248935 | A1 * | 10/2008 | Solow | A63B 21/154 482/142 |
| 2010/0323857 | A1 * | 12/2010 | D'Silva | A63B 22/0007 482/121 |
| 2012/0083394 | A1 * | 4/2012 | Gregor | A63B 21/4035 482/121 |
| 2012/0283079 | A1 * | 11/2012 | Solow | A63B 21/00065 482/142 |
| 2016/0096060 | A1 * | 4/2016 | Ho | A63B 21/0442 482/122 |
| 2021/0291009 | A1 * | 9/2021 | Paganini | A63B 71/0622 |
| 2022/0314055 | A1 * | 10/2022 | Wuttke | A63B 22/0087 |
| 2024/0009512 | A1 * | 1/2024 | Delgatty | A63B 21/002 |

FOREIGN PATENT DOCUMENTS

| | | | | |
|---|---|---|---|---|
| CN | 113350744 | A | 9/2021 | |
| KR | 20-0470891 | Y1 | 1/2014 | |
| KR | 10-2092669 | B1 | 3/2020 | |
| KR | 10-2305928 | B1 | 9/2021 | |
| KR | 10-2312252 | B1 | 10/2021 | |
| KR | 20-0496807 | Y1 | 4/2023 | |
| WO | WO-9944699 | A1 * | 9/1999 | A63B 69/0024 |
| WO | WO-2016103004 | A1 * | 6/2016 | A63B 1/00 |

* cited by examiner

COLLAPSIBLE MULTIPURPOSE EXERCISE EQUIPMENT

TECHNICAL FIELD

The present invention relates to exercise equipment, and more particularly, to multipurpose exercise equipment which is collapsible as needed so as to occupy less space, and which has a variety of functions.

BACKGROUND TECHNOLOGY

There is a wide consensus on the necessity of health management through exercise, which can be said to be essential to modern people. Accordingly, various exercise programs and facilities are being developed, and we can find the site of easily the operation. Some of the many types of exercise do not use tools, but there are many types of exercise that use tools and props. For example, the pilates which uses various devices such as a reformer, a barrel, a ring, a cadillac, and the like may be a representative exercise using the devices.

Equipment or devices used for exercise can have a great influence on the content and effects of the exercise. In addition, since the user relies on the equipment during the exercise, it can also be an important factor for the user's physical safety and convenience in exercising. In other words, the instrument must be safe, easy to handle, and at the same time, it is desirable to be designed in consideration of the efficiency of the motion.

DETAILED DESCRIPTION OF THE INVENTION

Technical Problems

The present invention provides an exercise equipment having various functions and uses.

The present invention provides an exercise equipment to be conveniently handled by a user.

The present invention provides an exercise equipment for effective exercise.

Technical Solving Method

According to an embodiment of the present invention, the exercise equipment may include includes a first body unit 110 or 110' which includes: a first frame 211*a* and a second frame 211*b* disposed vertically to the surface and parallel to each other, a third frame 212*a* and a fourth frame 212*b* connecting the first frame 211*a* to the second frame 211*b*, a first connecting frame 214*a* connected to the third frame 212*a*, and a second connecting frame 214*b* connected to the fourth frame 212*b*; and a second body unit 120 or 120' which includes: a border frame 311 including connection shafts 313*a* and 313*b* inserted into a first hole formed in the first connecting frame 214*a* and a second hole formed in the second connecting frame 214*b*, and cushion units 321, 322 and 323 or 381, 382, 383*a* and 383*b* which are arranged on one side of the border frame 311. The cushion units 321, 322 and 323 or 381, 382, 383*a* and 383*b* comprises a first cushion unit 321 or 381 having a first length, a second cushion unit 322 or 382 having the first length and detachable, and a third cushion unit 323, 383*a* or 383*b* having a second length, the second body unit 120 or 120' is capable to rotate between the ground and the first body unit 110 or 110' by rotating about an axis across the first hole and the second hole, and has one of an unfolded state parallel to the ground on a side surface and a folded state parallel to the first body unit 110 or 110' on the side surface, and the second body unit 120 or 120' includes a moving frame 411 disposed under the cushion units 321, 322 and 323, or 381, 382, 383*a* and 383*b* and movable along rails 681*a*, 681*b* installed on the inner surface of the border frame 311.

Effects of the Invention

The present invention may improve the effects of exercise and increase the convenience of exercise.

EMBODIMENTS FOR THE PRACTICE OF THE INVENTION

Hereinafter, preferred embodiments of the present invention will be described in detail with reference to the accompanying drawings. In describing the present invention, when it is determined that a detailed description of a related known function or feature may unnecessarily obscure the gist of the present invention, the detailed description will be omitted.

In addition, the terms or words used in the present specification and claims should not be necessarily construed as being limited to ordinary or dictionary meanings, but should be construed as meanings and concepts corresponding to the proposed technical ideas in accordance with the principle that the concepts of the terms can be appropriately defined to describe the invention in the best way.

In addition, in the present specification, a singular expression may be understood to include a plural expression unless there is a clear exception in the context or it is contradictory to interpret it as a plural.

Hereinafter, the present invention relates to exercise equipment. More particularly, the present invention relates to a multipurpose exercise apparatus which can be folded, as needed, to occupy less space and which has a variety of functions.

Figure 1A:
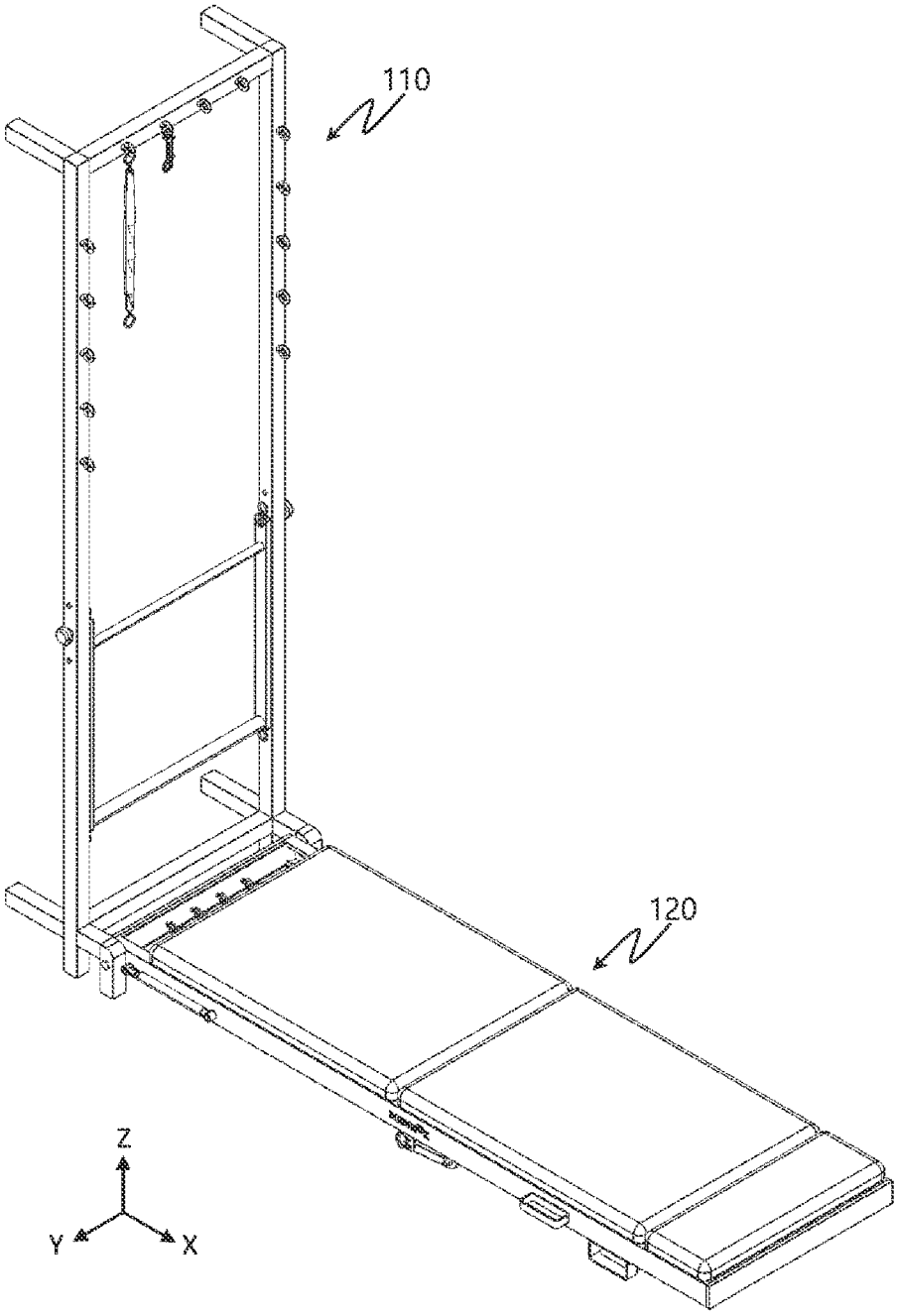
FIGS. 1A and 1B illustrate perspective views of an exercise equipment according to an embodiment of the present invention.
Figure 1B:
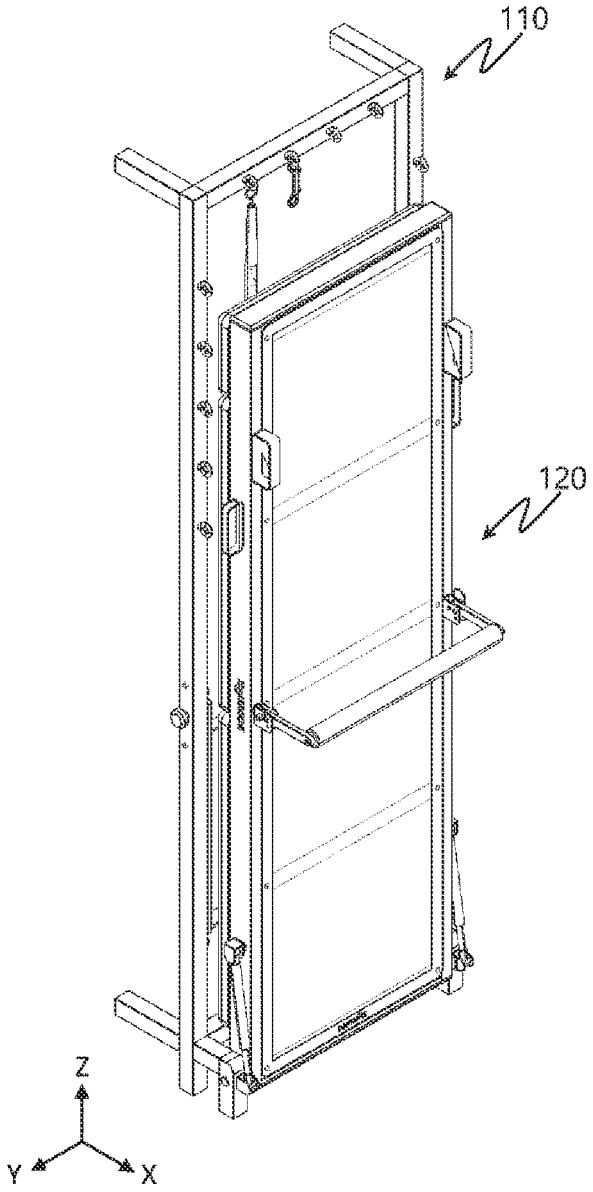

FIGS. 1A and 1B illustrate perspective views of an exercise equipment according to an embodiment of the present invention. FIG. 1A is a perspective view of an unfolded state of the exercise equipment, and FIG. 1B is a perspective view of a folded state of the exercise equipment.

Referring to FIGS. 1A and 1*i*, the exercise equipment includes a first body unit 110 and a second body unit 120. The first body unit 110 and the second body unit 120 are physically connected to each other at a unit of an end of the first body unit 110. Each of the first body unit 110 and the second body unit 120 is configured to include a plurality of feature elements, and each detailed structure will be described below.

In a state in which the exercise equipment is unfolded as illustrated in FIG. 1A, the first body unit 110 is vertically erected on the floor, and the second body unit 120 is horizontally placed on the floor. As shown in FIG. 1B, when the exercise equipment is folded, the first body unit 110 is vertically erected on the floor, and the second body unit 120 is horizontally placed on the floor. Comparing FIGS. 1A and 1B, the posture of the first body unit 110 is the same in the two states, and the second body unit 120 in the folded state is rotated by 90° with respect to the bottom by using a unit connected to the first body unit 110 as an axis, compared to the unfolded state, thereby facing the first body unit 110.

Figure 2:
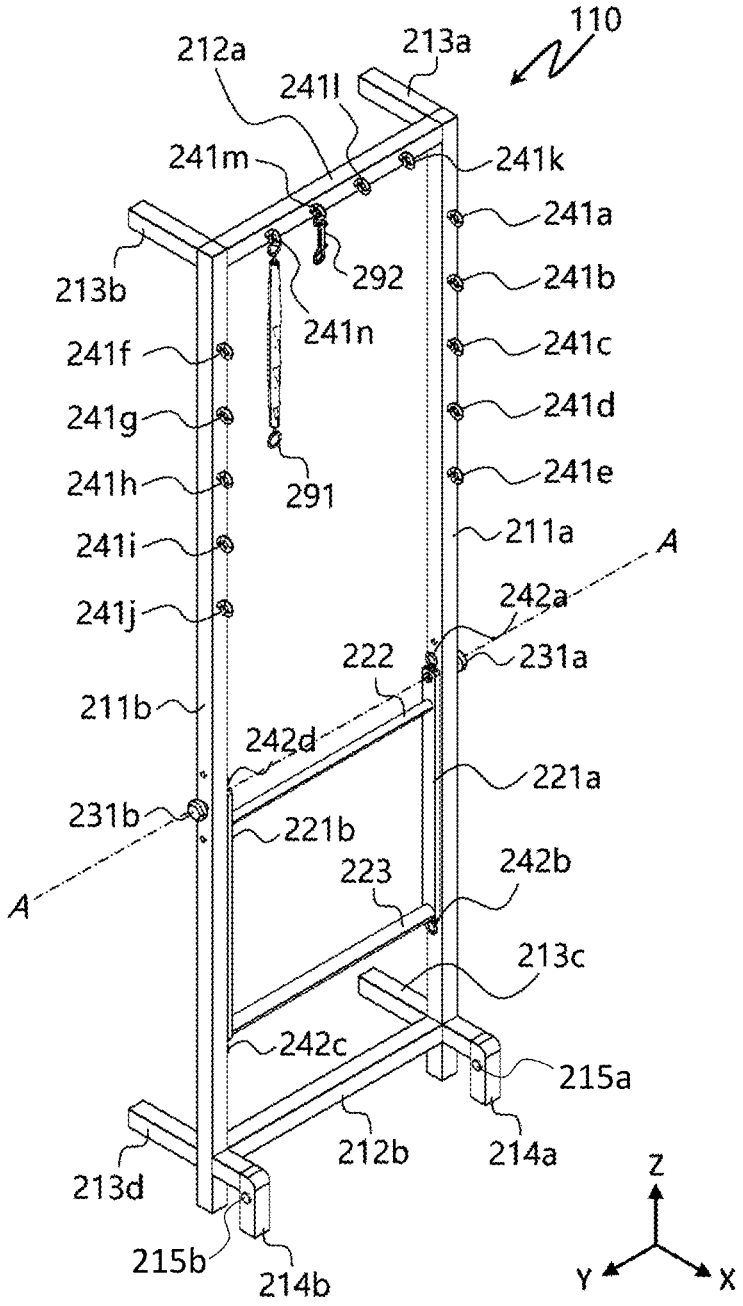
FIG. 2 illustrates a structure of a first body unit of the exercise equipment according to an embodiment of the present invention.

FIG. 2 shows the structure of the first body unit 110 of the exercise equipment according to an embodiment of the present invention.

Referring to FIG. 2, the first body unit 110 includes a plurality of frames 211*a*, 211*b*, 212*a*, 212*b*, 213*a*, 213*b*, 213*c*, 213*d*, 214*a*, and 214*b*, a pair of rotation arms 221*a* and 221*b*, a rotation arm connection bar 222, a rotation arm handle 223, connection members 231*a* and 231*b*, and a plurality of hooks 241*a* to 241*n*.

The plurality of frames 211*a*, 211*b*, 212*a*, 212*b*, 213*a*, 213*b*, 213*c*, 213*d*, 214*a*, and 214*b* form a basic structure of the first body unit 110. Each of the plurality of frames 211*a*, 211*b*, 212*a*, 212*b*, 213*a*, 213*b*, 213*c*, 213*d*, 214*a*, and 214*b* is formed of a pipe made of a hard material having a square having a predetermined width as a cross section. For example, the pipe may be made of a material having rigidity, for example, a metal.

The first frame 211*a* and the second frame 211*b* are disposed in parallel to be perpendicular to the X-Y plane (for example, the ground). Two ends of the third frame 212*a* perpendicular to the X-Z plane are connected to upper ends of the first frame 211*a* and the second frame 211*b*, and two ends of the fourth frame 212*b* perpendicular to the X-Z plane are connected to a predetermined height from lower ends of the first frame 211*a* and the second frame 211*b*. That is, the first frame 211*a*, the second frame 211*b*, the third frame 212*a*, and the fourth frame 212*b* are connected to each other to form a rectangular frame. According to an embodiment, the lengths of the third frame 212*a* and the fourth frame 212*b* may be smaller than the lengths of the first frame 211*a* and the second frame 211*b*.

A fifth frame 213*a*, a sixth frame 213*b*, a seventh frame 213*c*, and an eighth frame 213*d*, which are disposed to be perpendicular to the Y-Z plane, are connected to the upper end of the first frame 211*a*, the upper end of the second frame 211*b*, a point of a predetermined height from the lower end of the first frame 211*a*, and a point of a predetermined height from the lower end of the second frame 211*b*, respectively. The fifth frame 213*a*, the sixth frame 213*b*, the seventh frame 213*c*, and the eighth frame 213*d* have a shape protruding to be perpendicular to a rectangular frame formed by the first frame 211*a*, the second frame 211*b*, the third frame 212*a*, and the fourth frame 212*b*. Since the fifth frame 213*a*, the sixth frame 213*b*, the seventh frame 213*c*, and the eighth frame 213*d* all protrude in the same direction, when the first body unit 110 is laid on the floor, they may function as legs.

Alternatively, the fifth frame 213*a*, the sixth frame 213*b*, the seventh frame 213*c*, and the eighth frame 213*d* may be used as a connection means for fixing to a wall. In this case, in order to enable installation in various environments, the fifth frame 213*a* and the sixth frame 213*b* may be coupled to the first frame 211*a* and the second frame 211*b* in a movable structure. For example, the first frame 211*a* may include a plurality of holes to which a screw may be fastened, and the fifth frame 213*a* may be coupled to some of the plurality of holes through at least one screw, and a position (e.g., a position on the Z-axis) of the fifth frame 213*a* may vary depending on which hole the fifth frame 213*a* is coupled with.

A ninth frame 214*a* and a tenth frame 214*b* are connected to a surface of the first frame 211*a* and the second frame 211*b* opposite to a surface to which the seventh frame 213*c* and the eighth frame 213*d* are connected. Unlike other frames, the ninth frame 214*a* and the tenth frame 214*b* have an "L" shape. The ninth frame 214*a* and the tenth frame 214*b* may function as a connecting unit for connecting the first body unit 110 and the second body unit 120. Accordingly, the ninth frame 214*a* and the tenth frame 214*b* may be referred to as a connection frame.

The pair of rotating arms 221*a* and 221*b* are perpendicular to the X-Y plane and are placed to contact facing surfaces of the first frame 211*a* and the second frame 211*b*, respectively. The pair of rotation arms 221*a* and 221*b* are fixedly connected to each other by a rotation arm connection bar 222 and a rotation arm handle 223 on surfaces facing each other. The rotating arm connection bar 222 may be made of the same material as the pair of rotating arms 221*a* and 221*b*. The rotary arm handle 223 may have a larger cross-section than the rotary arm connection bar 222, and may be made of a material, such as wood, plastic, or the like, having a relatively lower strength than the rotary arm connection bar 222.

The pair of rotating arms 221*a* and 221*b* and the first frame 211*a* and the second frame 211*b* are connected to each other through connecting members 213*a* and 213*b*. The pair of rotation arms 221*a* and 221*b*, the rotation arm connection bar 222, and the rotation arm handle 223 may rotate about an axis A-A, perpendicular to the X-Z plane, accrosing centers of the connection members 231*a* and 231*b*.

The plurality of hooks 241*a* to 241*n* are elements for assembling auxiliary devices. The plurality of hooks 241*a* to 241*n* are disposed on the first frame 211*a*, the second frame 211*b*, and the third frame 212*a*. For example, various auxiliary devices 291 and 292 may be installed using the plurality of hooks 241*a* to 241*n*. In FIG. 2, the number of the plurality of hooks 241*a* to 241*n* is 14, but other numbers of hooks may be installed according to other embodiments. The hooks 242*a*, 242*b*, 242*c*, and 242*d* may also be installed in the pair of rotation arms 221*a* and 221*b*. Hooks 242*a*, 242*b*, 242*c*, and 242*d* may be respectively disposed at one end and the other end of the rotation arm 221*a* and one end and the other end of the rotation arm 221*b*.

Figure 3A:
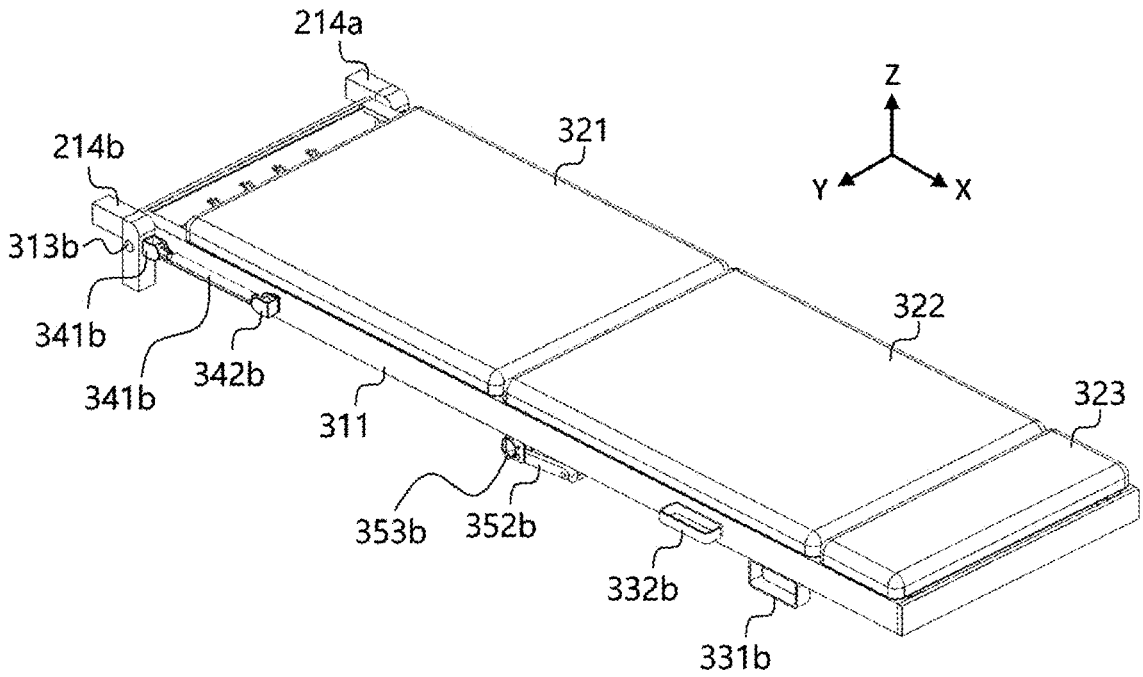
FIGS. 3A, 3B, and 3C illustrate a structure of a second body unit of the exercise equipment according to an embodiment of the present invention.
Figure 3B:
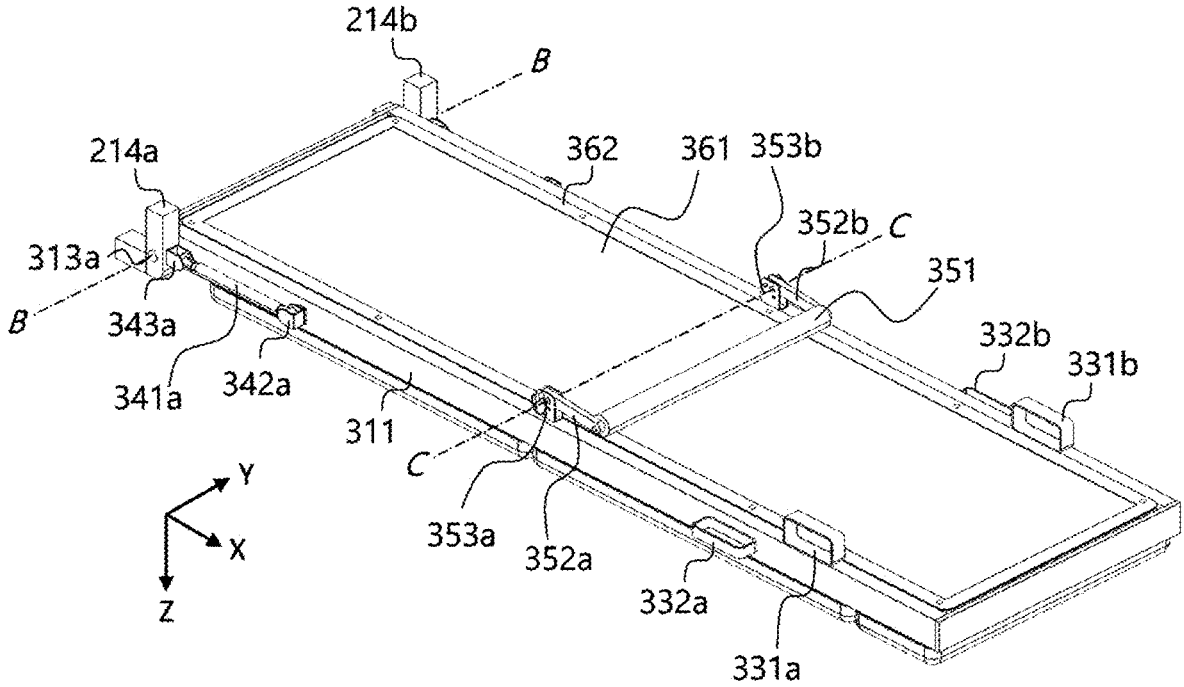
Figure 3C:
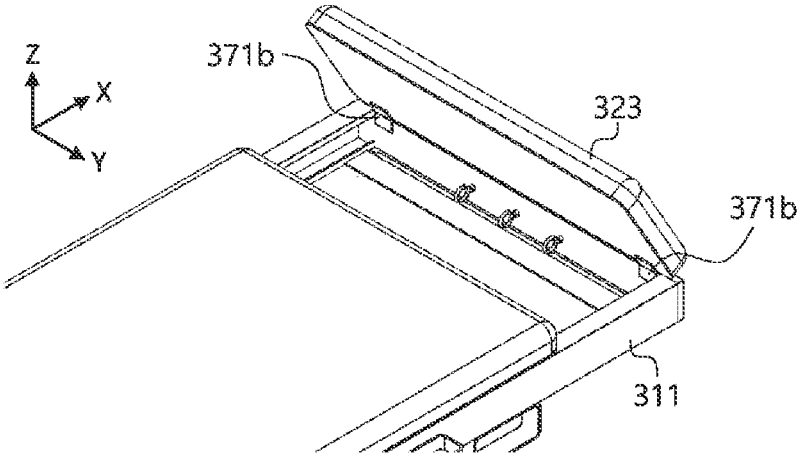

FIGS. 3A, 3B and 3C illustrate the structure of the second body unit 120 of the exercise equipment according to an embodiment of the present invention. FIG. 3A shows an upper side of the second body unit 120, and FIG. 3B shows a lower side of the second body unit 120. Hereinafter, the direction will be described based on a state in which the second body unit 120 is unfolded.

Referring to FIGS. 3A and 3B, the second main body 120 includes a border frame 311, a plurality of cushion units 321, 322, and 323, handles 331*a*, 331*b*, 332*a*, and 332*b*, shock absorbers 341*a* and 341*b*, shock absorber fixing units 342*a*, 342*b*, 343*c*, and 343*d*, a ballet barre handle 351, ballet barre supporting units 352*a* and 352*b*, ballet barre fixing units 353*a* and 353*b*, a mirror 361, and a mirror edge 362.

The border frame 311 constitutes a basic structure of the second body unit 120, and is formed of a hard material. For example, the structure may have a metallic material. The border frame 311 has a rectangular shape having a predetermined thickness, and an internal structure thereof will be described in detail below. The border frame 311 contacts the ninth frame 214*a* and the tenth frame 214*b* of the first body unit 110 at the end of the negative direction of the X-axis. In detail, the connecting shafts 313*a* and 313*b* protruding in the positive (+) direction and the negative (−) direction of the Y-axis in the border frame 311 are in contact with each other in such a manner as to be inserted into the holes formed in the ninth frame 214*a* and the tenth frame 214*b*, respectively, so that the second body unit 120 may be folded or unfolded while the connecting shafts 313*a* and 313*b* rotate about the axis B-B parallel to the Y-axis in the holes.

The border frame 311 constitutes a basic structure of the second body unit 120, and is formed of a hard material. For example, the structure may have a metallic material. The border frame 311 has a rectangular shape having a predetermined thickness, and an internal structure thereof will be described in detail below. The border frame 311 contacts the ninth frame 214*a* and the tenth frame 214*b* of the first body unit 110 at the end of the negative direction of the X-axis. In detail, the connecting shafts 313*a* and 313*b* protruding in the positive (+) direction and the negative (−) direction of the Y-axis in the border frame 311 are in contact with each other in such a manner as to be inserted into the holes 215*a* and 215*b* formed in the ninth frame 214*a* and the tenth frame 214*b*, respectively, so that the second body unit 120 may be folded or unfolded while the connecting shafts 313*a* and 313*b* rotate about the axis B-B parallel to the Y-axis in the holes 215*a* and 215*b*.

The handles 331*a*, 331*b*, 332*a*, and 332*b* are divided into lower surface handles 331*a* and 331*b* facing the bottom (e.g., the negative direction of the Z axis) and side surface handles 332*a* and 332*b* facing the side. The lower surface handles 331*a* and 331*b* are attached to a surface of the border frame 311 facing the negative direction of the Z-axis, and are disposed to be symmetrical to any one virtual surface perpendicular to the Y-Z plane. The side handles 332*a* and 332*b* are respectively attached to a surface facing the negative (−) direction of the Y-axis and a surface facing the positive (+) direction of the border frame 311, and are disposed to be symmetrical to any one virtual surface perpendicular to the Y-Z plane.

The lower surface handles 331*a* and 331*b* may function as legs for supporting the second body unit 120 in the state in which the second body unit 120 is unfolded (e.g., the state of FIG. 1A), and may function as hooks for pulling the second body unit 120 to be unfolded in the state in which the second body unit 120 is folded (e.g., the state of FIG. 1). To this end, the lower surface handles 331*a* and 331*b* may be disposed at about ⅛ points from the positive (+) direction end of the X axis of the border frame 311. The side handles 332*a* and 332*b* may function as a hook for pulling the second body unit 120 to be folded in the unfolded state (e.g., the state of FIG. 1A). In addition, the side handles 332*a* and 332*b* may also function as a hook for pulling the second body unit 120 to extend in the state in which the second body unit 120 is folded (e.g., the state of FIG. 1B).

The shock absorber 341*a* and 341*b* prevent the second body unit 120 from being rapidly folded or unfolded while the states (e.g., folding and unfolding) of the first body unit 110 and the second body unit 120 are changed. That is, the shock absorbers 341*a* and 341*b* are components for the safety of the user. The shock absorbers 341*a* and 341*b* are connected to shock absorber fixing units 342*a* and 342*b* fixed to both side surfaces of the border frame 311, respectively, and connected to shock absorber fixing units 343*c* and 343*d* fixed to the ninth frame 214*a* and the tenth frame 214*b*, respectively.

The ballet barre handle 351 is a long bar parallel to the X-Y plane installed toward the floor and perpendicular to the X-Z plane. The ballet barre handle 351 is exposed while the second body unit 120 is folded. The ballet barre supports 352*a* and 352*b* are connected to both ends of the ballet barre handle 351 and are connected to the ballet barre fixing units 353*a* and 353*b* fixed to the border frame 311. The ballet barre supports 352*a*, 352*b* are not fixedly coupled to the ballet barre supports 353*a*, 353*b* and rotate about an axis C-C parallel to the Y axis.

The mirror 361 is installed on a surface facing the positive (+) direction of the Z-axis in the border frame 311, and is fixed to the border frame 311 by the mirror edge 362. The mirror 361 is exposed in a state in which the second body unit 120 is folded.

Figure 3D:
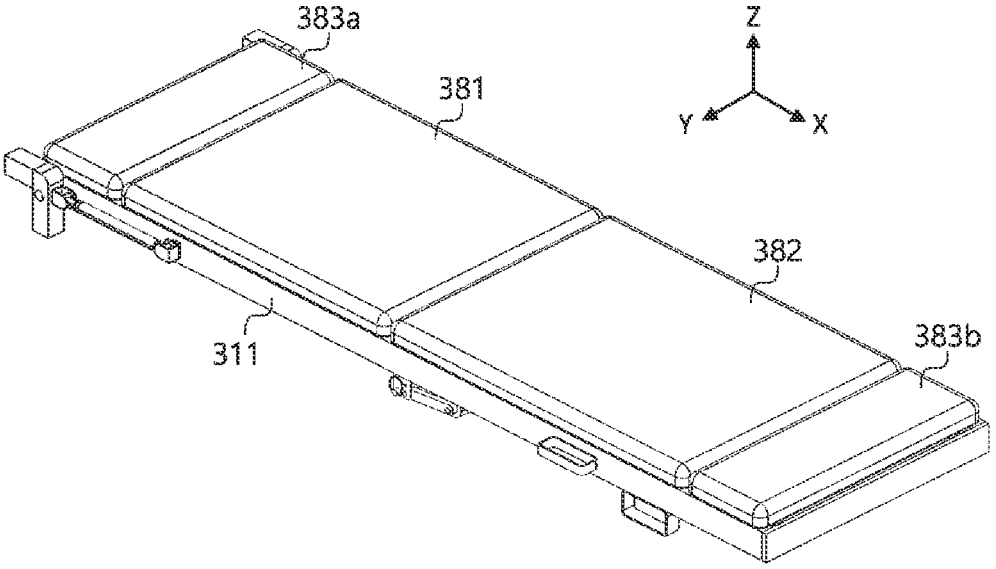
FIG. 3D illustrates another structure of cushions of a second body unit of the exercise equipment according to an embodiment of the present invention.

In the shape of the second body unit 120 described with reference to FIGS. 3A, 3B and 3C, three cushion units 321, 322, and 323 are disposed at the upper end of the border frame 311. However, according to another embodiment, two cushion units or four or more cushion units may be disposed at the upper end of the border frame 311. For example, as in FIG. 3D, four cushion units 381, 382, 383*a*, and 383*b* may be disposed. FIG. 3D illustrates another structure of cushions of the second body unit of the exercise equipment according to an embodiment of the present invention. Referring to FIG. 3D, four cushion units 381, 382, 383*a*, and 383*b* are disposed at an upper end of the border frame 311. Each of the two cushion units 383*a* and 383*b* disposed at both ends may be coupled to the border frame 311 by hinges, similarly to the cushion unit 323.

In the shape of the second main body 120 described with reference to FIGS. 3A, 3B and 3C, handles 331*a*, 331*b*, 332*a*, and 332*b*, which are divided into lower surface handles 331*a* and 331*b* facing the floor (e.g., the negative direction of the Z axis) and side surface handles 332*a* and 332*b* facing the side, are installed on the border frame 311.

Figure 3E:
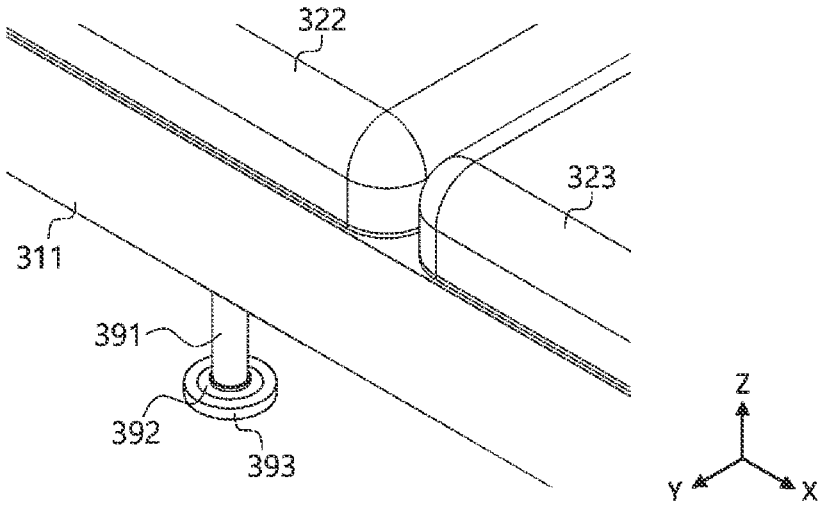
FIG. 3E illustrates an example of a structure that may replace the handles of the second body unit of the exercise equipment according to an embodiment of the present invention.

However, according to other embodiments, the handles 331*a*, 331*b*, 332*a*, and 332*b* may be omitted, and as illustrated in FIG. 3E, support members for replacing the lower handles 331*a* and 331*b* may be added. FIG. 3E illustrates a structure that may replace the handles 331*a* and 331*b* of the second body unit 120 of the exercise equipment according to an embodiment of the present invention. Referring to FIG.

3E, each of the support members may include a first member 391 having a pillar shape made of a metal, a second member 392 assembled to one end of a lower side of the first member 391, and a rubber packing 393 coupled to the second member 392. In this case, the support members may be designed to be adjustable in length. For example, when a screw groove is formed on a surface of the first member 391 and a screw hole is formed in the second member 392, the second member 392 functions like a nut as the first member 391 functions like a bolt such that a height at which the second member 392 is assembled may be adjusted.

Figure 4:
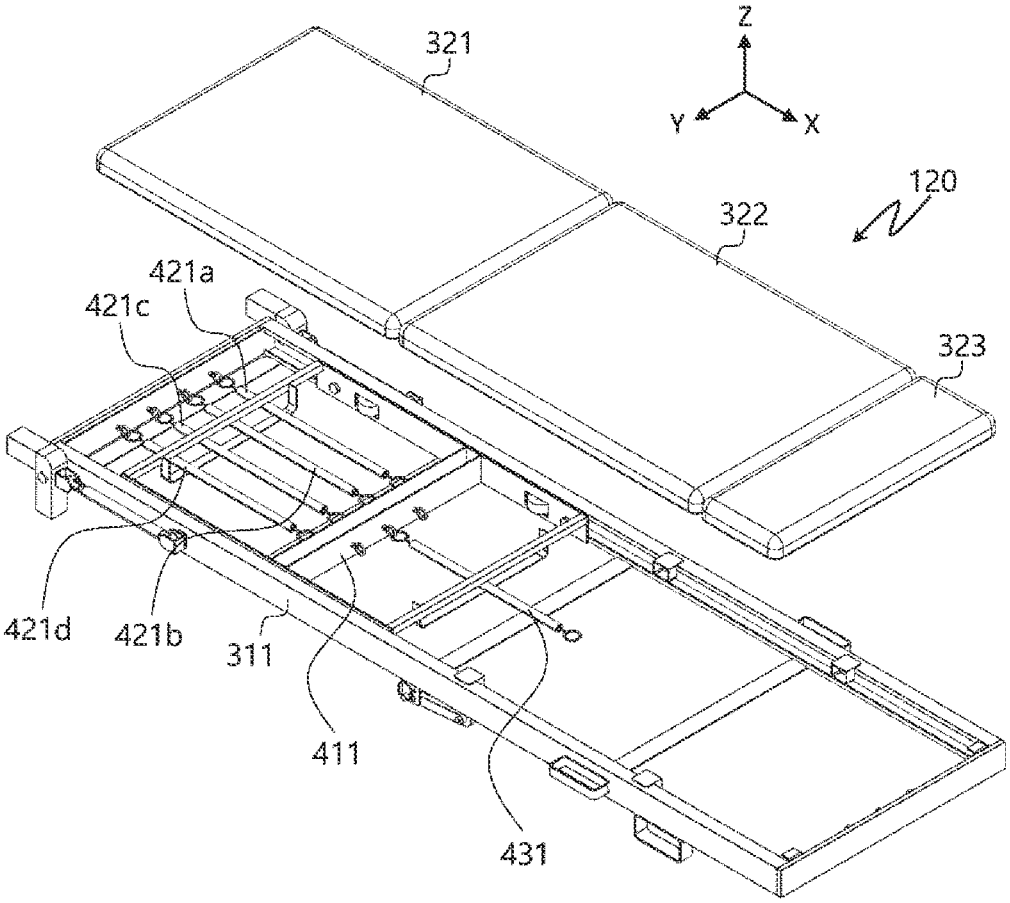
FIG. 4 illustrates an internal structure of a second body unit of the exercise equipment according to an embodiment of the present invention.

FIG. 4 illustrates an internal structure of the second body unit of the exercise equipment according to an embodiment of the present invention. FIG. 4 illustrates the inside covered by the plurality of cushion units 321, 322, and 323.

The plurality of cushion units 321, 322, and 323 are separable components, and each of the plurality of cushion units 321, 322, and 323 may be separated. For example, although not illustrated in FIG. 4, the edge area of the bottom surface of each of the cushion units 321, 322, and 323 may be made of metal, and the magnets may be coupled to the border frame 311. In this case, the cushion units 321, 322, and 323 may be attached to the border frame 311 by a magnet. When the plurality of cushion units 321, 322, and 323 are lifted up, the inside of the border frame 311 is exposed. The moving frame 411 is disposed inside the border frame 311, and a plurality of elastic members 421*a*, 421*b*, 421*c*, 421*d*, and 431 are assembled in the inner space of the moving frame 411. In a state where the plurality of cushion units 321, 322, and 333 are attached, the moving frame 411 is coupled to the upper cushion unit 321. The plurality of elastic members 421*a*, 421*b*, 421*c*, 421*d*, and 431 may be implemented as springs, fiber bands, rubber bands, or the like. The connection relationship between the moving frame 411 and the plurality of elastic members 421*a*, 421*b*, 421*c*, 421*d*, and 431 will be described with reference to FIGS. 5A and 5B.

Figure 5A:
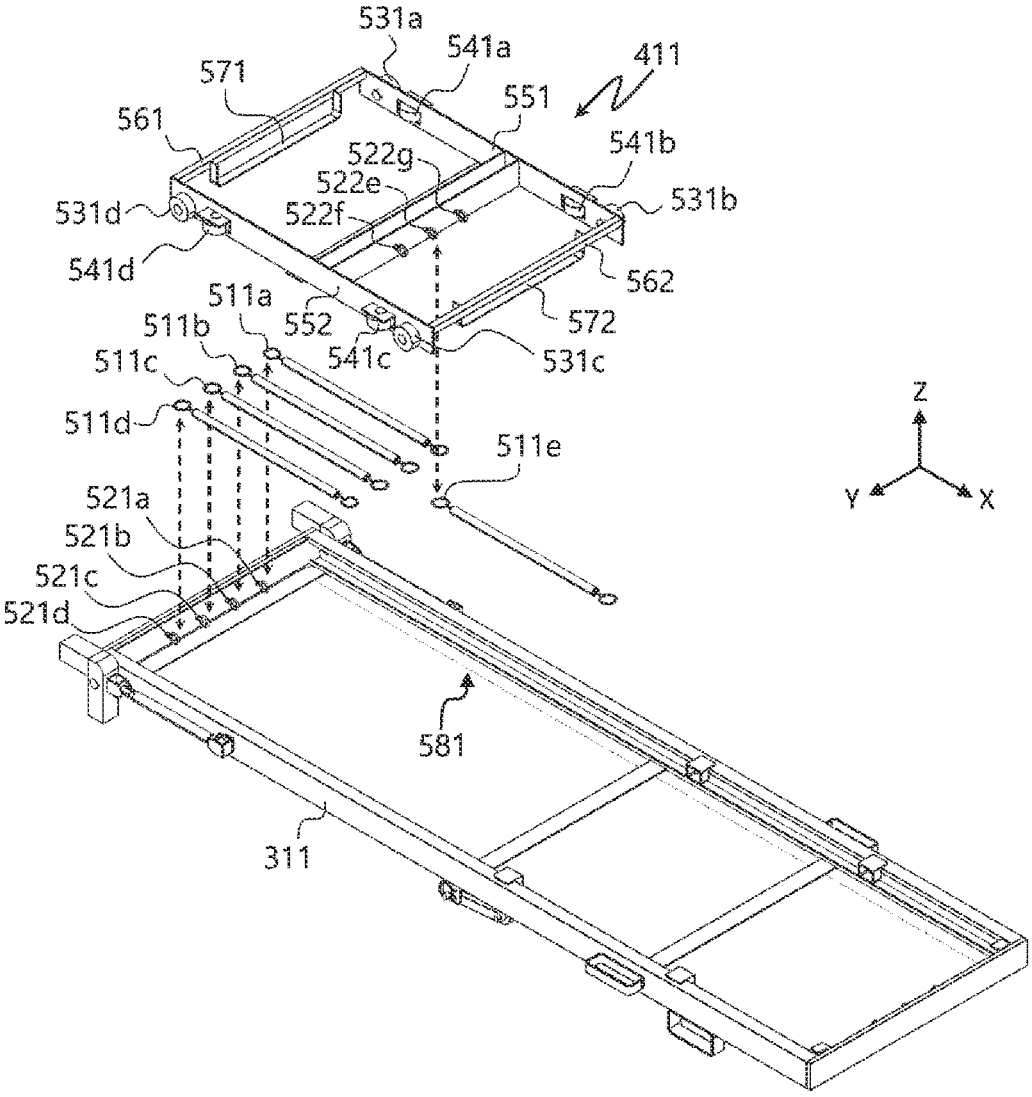
FIGS. 5A and 5B illustrate an exploded structure of a second body unit of the exercise equipment according to an embodiment of the present invention.
Figure 5B:
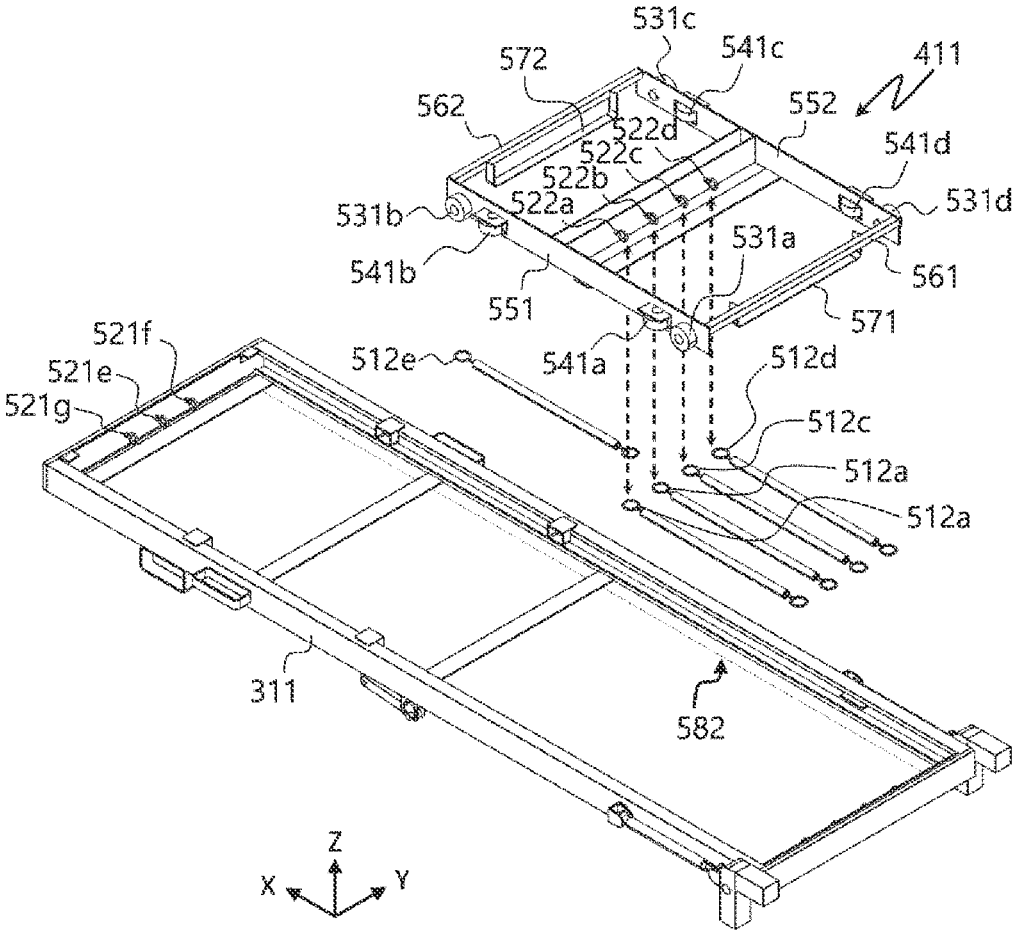

FIGS. 5A and 5B illustrate an exploded shape of a second body unit of the exercise equipment according to an embodiment of the present invention. FIGS. 5A and 5B illustrate a shape in which the moving frame 411 and the plurality of elastic members 421*a*, 421*b*, 421*c*, 421*d*, and 431 are disassembled from the border frame 311 in different directions. In a general use state of the exercise equipment according to an embodiment of the present invention, a situation in which the exercise equipment is disassembled as shown in FIGS. 5A and 5B is not observed, but FIGS. 5A and 5B are provided to explain the structure.

Referring to FIGS. 5A and 5B, pairs of hooks 511*a*, 511*b*, 511*c*, 511*d*, 511*e*, 512*a*, 512*b*, 512*c*, 512*d*, and 512*e* are coupled to two ends of each of the elastic members 421*a*, 421*b*, 421*c*, 421*d*, and 431. Specifically, the hook 511*a* and the hook 512*a* are fixedly coupled to both ends of the elastic member 421*a*, the hook 511*b* and the hook 512*b* are fixedly coupled to both ends of the elastic member 421*b*, the hook 511*c* and the hook 512*c* are fixedly coupled to both ends of the elastic member 421*c*, the hook 511*d* and the hook 512*d* are fixedly coupled to both ends of the elastic member 421*d*, the hook 511*e* and the hook 512*e* are fixedly coupled to both ends of the elastic member 421*e*, and the hook 511*f* and the hook 512*f* are fixedly coupled to both ends of the elastic member 421*f*.

The elastic members 421*a*, 421*b*, 421*c*, 421*d*, and 431 may be assembled to the border frame 311 and the moving frame 411 through the hooks 511*a*, 511*b*, 511*c*, 511*d*, 511*e*, 512*a*, 512*b*, 512*c*, 512*d*, and 512*e*. To this end, the fixing hooks 521*a*, 521*b*, 521*c*, 521*d*, 521*e*, 521*f*, and 521*g* are formed on the inner wall of the space formed by the border frame 311, and the fixing hooks 522*a*, 522*b*, 522*c*, 522*d*, 522*e*, 522*f*, and 522*g* are formed on the inner wall formed in parallel with the Y-Z plane inside the moving frame 411. Specifically, as represented by dotted lines in FIG. 5A, the hooks 511*a*, 511*b*, 511*c*, 511*d*, and 511*e* may be assembled to the fixed hooks 521*a*, 521*b*, 521*c*, 521*d*, and 522*e*, respectively. Similarly, as represented by a dotted line in FIG. 5B, the hooks 512*a*, 512*b*, 512*c*, 512*d* may be respectively assembled to the fixed hooks 522*a*, 522*b*, 522*c*, 522*d*. When the hooks 512*a*, 512*b*, 512*c*, 512*d* and the fixed hooks 522*a*, 522*b*, 522*c*, 522*d* are disassembled, the hook 512*e* may be assembled to the fixed hook 521*e*. In some cases, the hook 512*e* may be assembled to the fixed hook 521*e* while maintaining the assembly of the hooks 512*a*, 512*b*, 512*c*, 512*d* and the fixed hooks 522*a*, 522*b*, 522*c*, 522*d*.

In addition, the moving frame 411 includes two side walls 551 and 552 parallel to the X-Z plane, and two pairs of bottom wheels 531*a*, 531*b*, 531*c*, and 531*d* and two pairs of side wheels 541*a*, 541*b*, 541*c*, and 541*d* are disposed on the two side walls 551 and 552. The two pairs of bottom wheels 531*a*, 531*b*, 531*c*, and 531*d* are installed near both ends of the outer surfaces of the side walls 551 and 552, and the two pairs of side wheels 541*a*, 541*b*, 541*c*, and 541*d* are installed by being inserted into holes formed adjacent to the two pairs of bottom wheels 531*a*, 531*b*, 531*c*, and 531*d*. The two pairs of lower wheels 531*a*, 531*b*, 531*c*, and 531*d* and the two pairs of side wheels 541*a*, 541*b*, 541*c*, and 541*d* perform a function of reducing friction so that the moving frame 411 may easily move in parallel to the X-Y plane along the rails 581 and 582 formed on the inner surface of the border frame 311.

The side walls 551 and 552 are connected at both ends through connection bars 561 and 562. The elastic member protection frames 571 and 572 are coupled to the connection bars 561 and 562, respectively. In the state in which the elastic members 421*a*, 421*b*, 421*c*, 421*d*, and 431 are assembled through the hooks 511*a*, 511*b*, 511*c*, 511*d*, 511*e*, 512*a*, 512*b*, 512*c*, 512*d*, and 512*e*, the elastic members 421*a*, 421*b*, 421*c*, 421*d*, and 431 are surrounded by the connection bars 561 and 562 and the elastic member protection frames 571 and 572.

Figure 6A:
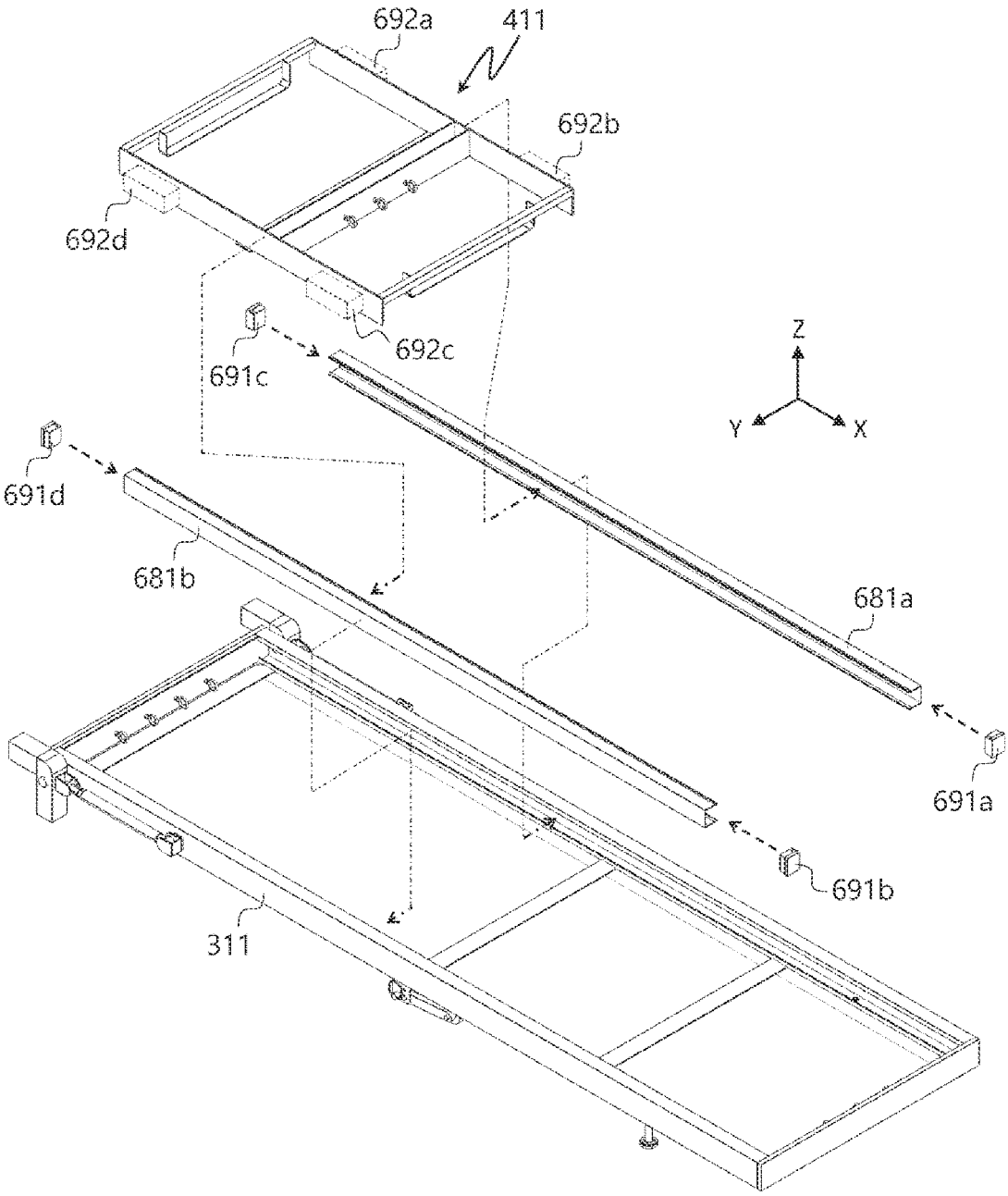
FIGS. 6A, 6B, and 6C illustrate another structure of components for moving a moving frame according to an embodiment of the present invention.
Figure 6B:
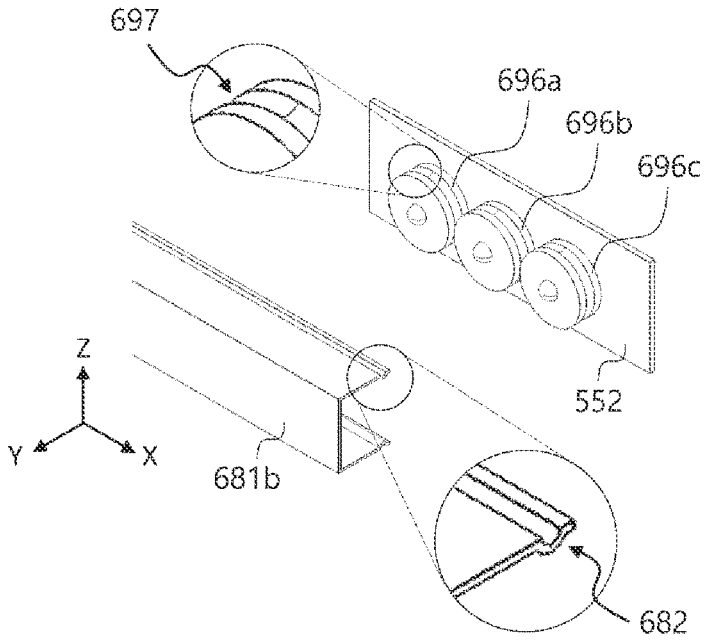
Figure 6C:
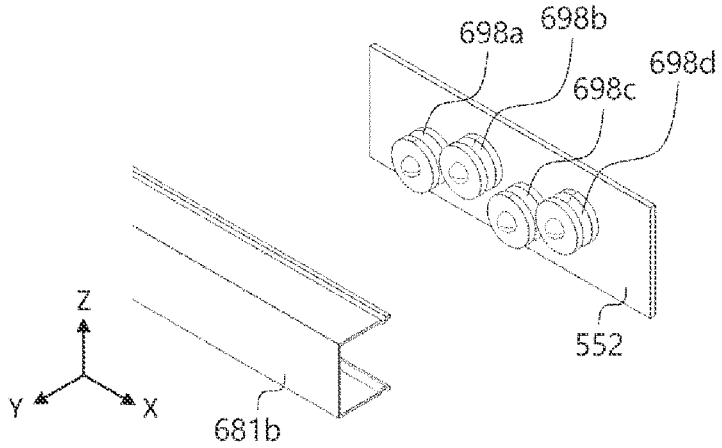

In the structure described with reference to FIGS. 5A and 5B, the rails 581 and 582 are described as being a unit of the border frame 311. However, according to another embodiment, as illustrated in FIG. 6A, the rails 581 and 582 may be manufactured as components separate from the border frame 311. FIGS. 6A, 6B and 6C illustrate another structure of elements for moving the moving frame 411 according to an embodiment of the present invention. Referring to FIG. 6A, separate rails 681*a* and 681*b* may be assembled to the inner surface of the border frame 311 through a coupling means such as at least one screw. Also, the moving frame 411 moves in parallel with the X-axis between the rails 681*a* and 681*b*. Guide members 692*a* to 692*d* may be attached to the moving frame 411 so that the moving frame 411 moves along the rails 681*a* and 681*b* between the rails 681*a* and 681*b*. Further, covers 691*a* to 691*d* or stoppers may be coupled to both ends of the rails 692*a* and 692*d* so that the guide members 681*a* to 681*b* do not deviate from the rails 681*a* and 681*b*.

Herein, an example of the guide members 692*a* to 692*d* is two pairs of lower wheels 531*a*, 531*b*, 531*c*, and 531*d* and two pairs of side wheels 541*a*, 541*b*, 541*c*, and 541*d* described with reference to FIGS. 5A and 5B. In this case, the third guide member 692*a*, which is one of the guide members 692*c* to 692*d*, includes one lower wheel 531*a* and one side wheel 541*a*. According to another exemplary embodiment of the present disclosure, other components may be used instead of the two pairs of lower wheels 531*a*, 531*b*, 531*c*, and 531*d* and the two pairs of side wheels 541*a*, 541*b*, 541*c*, and 541*d*. An example of another component that may replace the two pairs of bottom wheels 531*a*, 531*b*, 531*c*, 531*d* and the two pairs of side wheels 541*a*, 541*b*, 541*c*, 541*d* is as in FIG. 6B or 6C. FIGS. 6B and 6C each show an example of a third guide member 692*c* which is one of the guide members 692*a* to 692*d* and a second rail 681*b* which is one of the rails 681*a* and 681*b*.

Referring to FIG. 6B, according to another embodiment, the third guide member 692*c* attached to the side wall 552 of the moving frame 411 includes a plurality of wheels 696*a*, 696*b* and 696*c*. A plurality of wheels 696*a*, 696*b* and 696*c* are arranged at regular intervals on the X-axis and arranged on the same Z-axis coordinate. For stable fixation between the plurality of wheels 696*a*, 696*b* and 696*c* and the second rail 681*b* and 696*b*, at least one groove 697 is formed on a surface of each of the wheels 696*a*, 696*b* and 696*c*, and the second rail 681*b* includes a long protrusion 682 fitting the at least one groove 697 and protruding toward the plurality of wheels 696*a*, 696*b* and 696*c*.

Referring to FIG. 6C, according to further another embodiment, the third guide member 692*c* attached to the side wall 552 of the moving frame 411 includes a plurality of wheels 698*a*, 698*b*, 698*c*, and 698*d*. The plurality of wheels 698*a*, 698*b*, 698*c*, and 698*d* are arranged in a zigzag manner on the side wall 552, for example, at regular intervals on the X-axis, alternately at two Z-axis coordinates. Also, similar to the case of FIG. 6B, for stable fixation between the plurality of wheels 698*a*, 698*b*, 698*c* and 698*d* and the second rail 681*b*, at least one groove may be formed on the surfaces of the wheels 698*a*, 698*b*, 698*c*, and 698*d*, and the second rail 681*b* may include a long protrusion corresponding (e.g., fitting) to the at least one groove 697.

Although FIGS. 6B and 6C show examples of the third guide member 692*c* and the second rail 681*b*, it is obvious that the other guide members 692*a*, 692*b*, or 692*d* and the other rail 691*a* may have similar structures.

Figure 7:
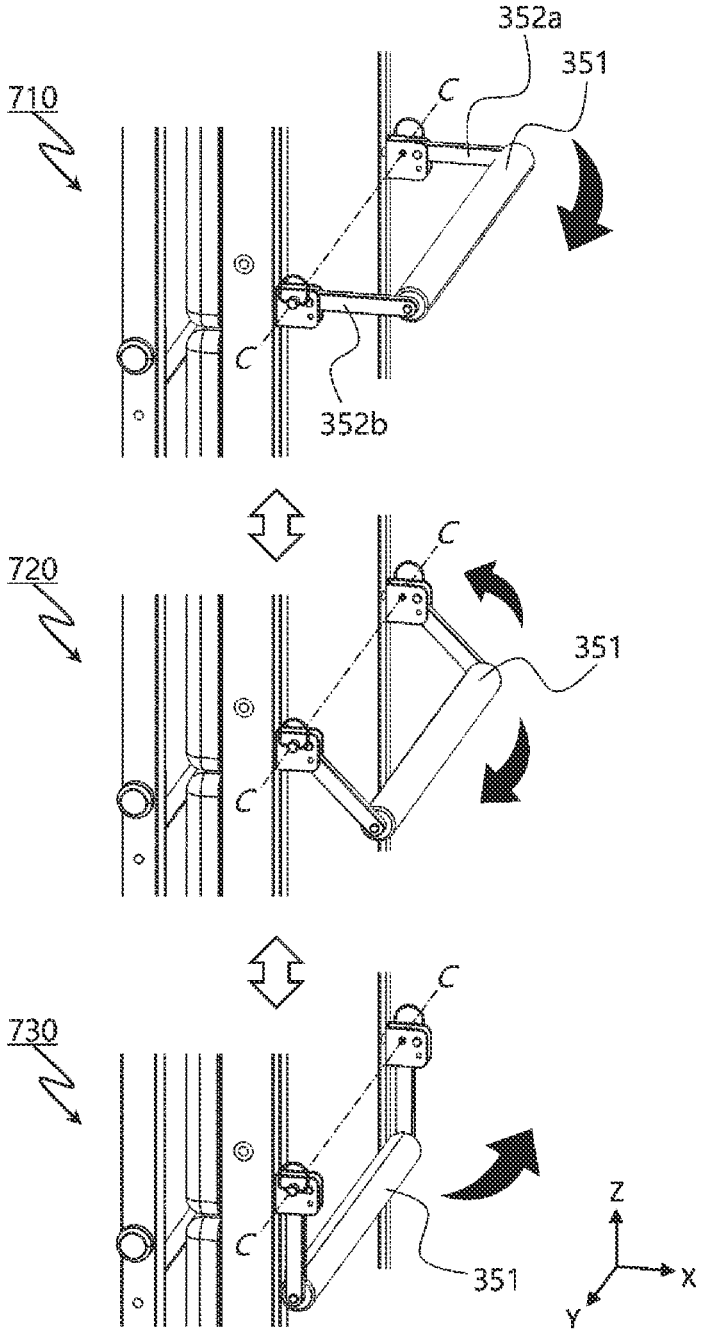
FIG. 7 illustrates states of use of a ballet barre of the exercise equipment according to an embodiment of the present invention.

FIG. 7 illustrates states of use of a ballet barre of the exercise equipment according to an embodiment of the present invention. FIG. 7 shows three states 710, 720, and 730 of the ballet barre consisting of a ballet barre handle 351 and ballet barre supports 352*a* and 352*b*. In the first state 710, when the ballet barre handle 351 is lowered in a downward direction (e.g., the −direction of the Z axis), the ballet barre handle 351 and the ballet barre support units 352*a* and 352*b* rotate about the axis C-C, and sequentially change into the second state 720 and the third state 730. On the contrary, in the third state 730, when the user lowers the ballet barre handle 351 in the upward direction (e.g., the positive direction of the Z axis), the ballet barre handle 351 and the ballet barre support units 352*a* and 352*b* rotate about the axis C-C, and the state sequentially changes to the second state 720 and the first state 710.

Figure 8:
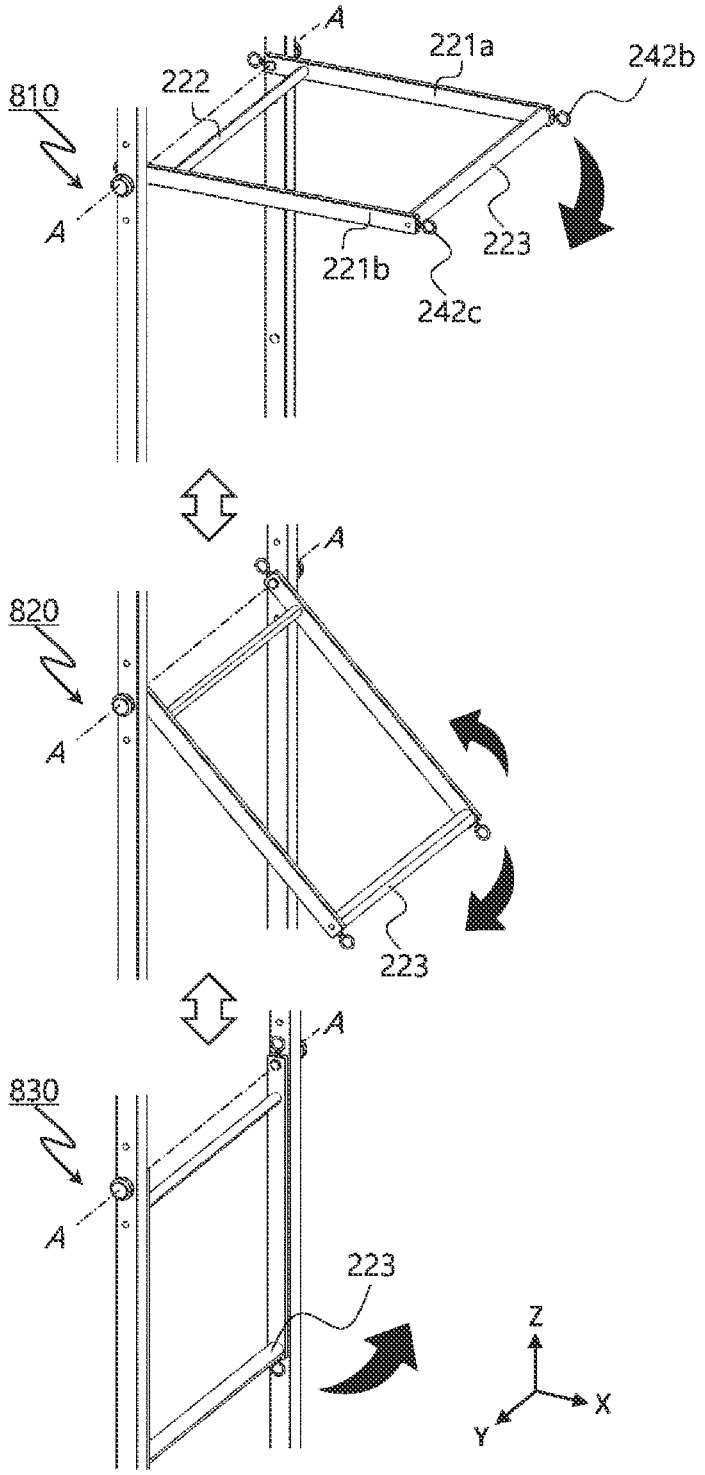
FIG. 8 illustrates states of use of a push thru bar of an exercise equipment according to an embodiment of the invention.

FIG. 8 illustrates states of use of a push thru bar of an exercise equipment according to an embodiment of the invention. FIG. 8 shows three states 810, 820, 830 of the push-through bar, which consists of a pair of rotating arms 221*a*, 221*b*, rotating arm connection bar 222, rotating arm handle 223. In the first state 810, when the rotation arm handle 223 is lowered in a downward direction (e.g., a negative direction of the Z axis), the pair of rotation arms 221*a* and 221*b*, the rotation arm connection bar 222, and the rotation arm handle 223 rotate about the axis A-A, and sequentially change to the second state 820 and the third state 830. On the contrary, in the third state 830, when the ballet barre handle 351 is lowered in the upward direction (e.g., the positive direction of the Z axis), the pair of rotating arms 221*a* and 221*b*, the rotating arm connection bar 222, and the rotating arm handle 223 rotate about the axis A-A, and sequentially change to the second state 820 and the first state 810. In the first state 810, when one end of two elastic members (e.g., the auxiliary devices 291) is assembled to each of the hooks 242*b* and 242*c* and the other end is assembled to any one of the plurality of hooks 241*a* to 241*n*, the first state 810 is maintained by the elastic member, and the user may perform various exercises using that.

Figure 9:
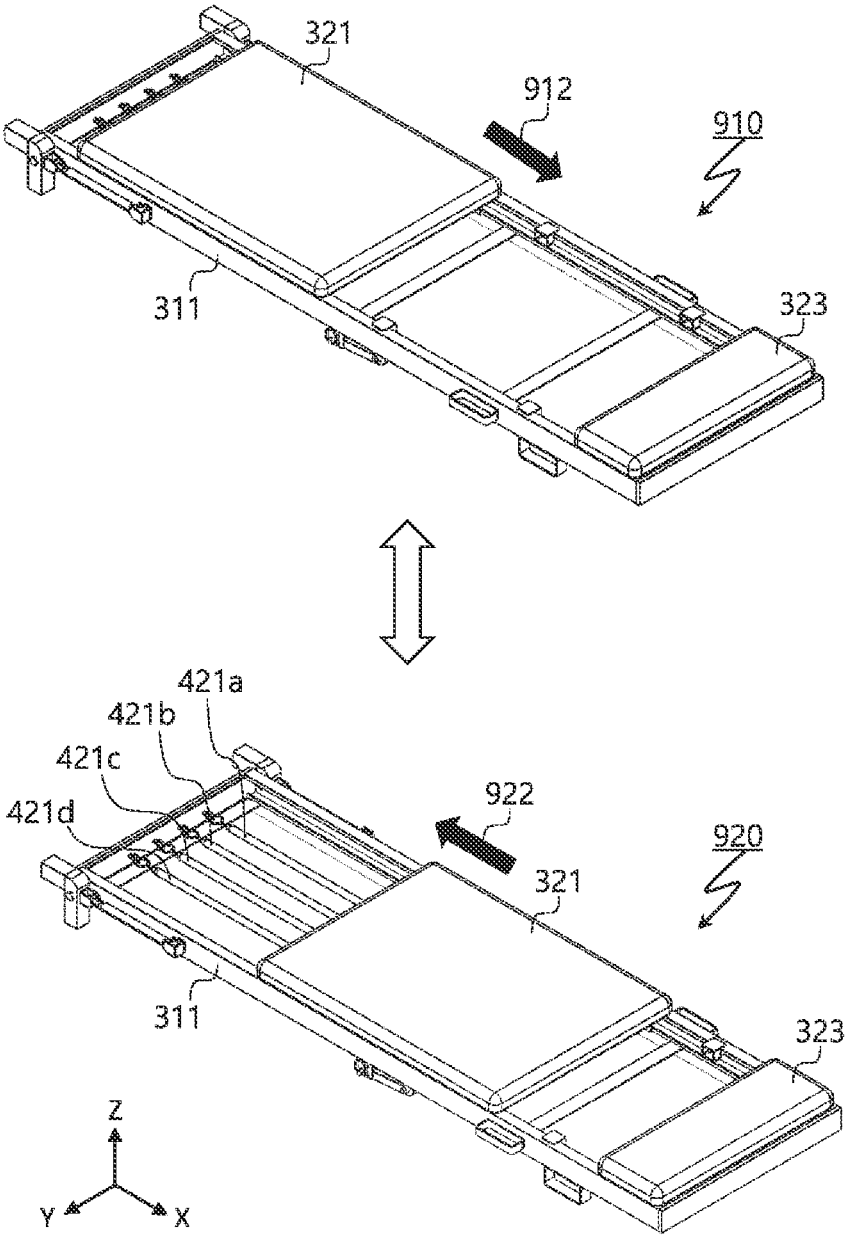
FIG. 9 illustrates states of use of cushion units of the exercise equipment according to an embodiment of the present invention.

FIG. 9 illustrates states of use of the cushion unit of the exercise equipment according to an embodiment of the present invention. FIG. 9 shows two states 910 and 920 of the cushion. A first state 910 is a state in which the intermediate cushion unit 322 is removed. As the intermediate cushion unit 322 is removed, a space in which the upper cushion unit 321 may move may be formed. In the first state 910, when a force is applied to the upper cushion unit 321 in a direction of an arrow 912, the upper cushion unit 321 moves along the X-axis and approaches the lower cushion unit 323 as in the second state 920. In this case, since the upper cushion unit 321 is coupled to the moving frame 411, the elastic members 421*a*, 421*b*, 421*c*, and 421*d* of which one end and the other end are assembled with the moving frame 411 and the border frame 311 are stretched by the force. Accordingly, when the stretched elastic members 421*a*, 421*b*, 421*c*, and 421*d* generate a force to return to the original state and, if the force in the direction of the arrow 912 is not maintained, the upper cushion unit 321 returns in the direction of the arrow 922. That is, the elastic members 421*a*, 421*b*, 421*c*, and 421*d* resist movement of the upper cushion unit 321 and the moving frame 411. Using this, the user may perform an exercise of maintaining a force by pushing the upper cushion unit 321 using the body.

Figure 10A:
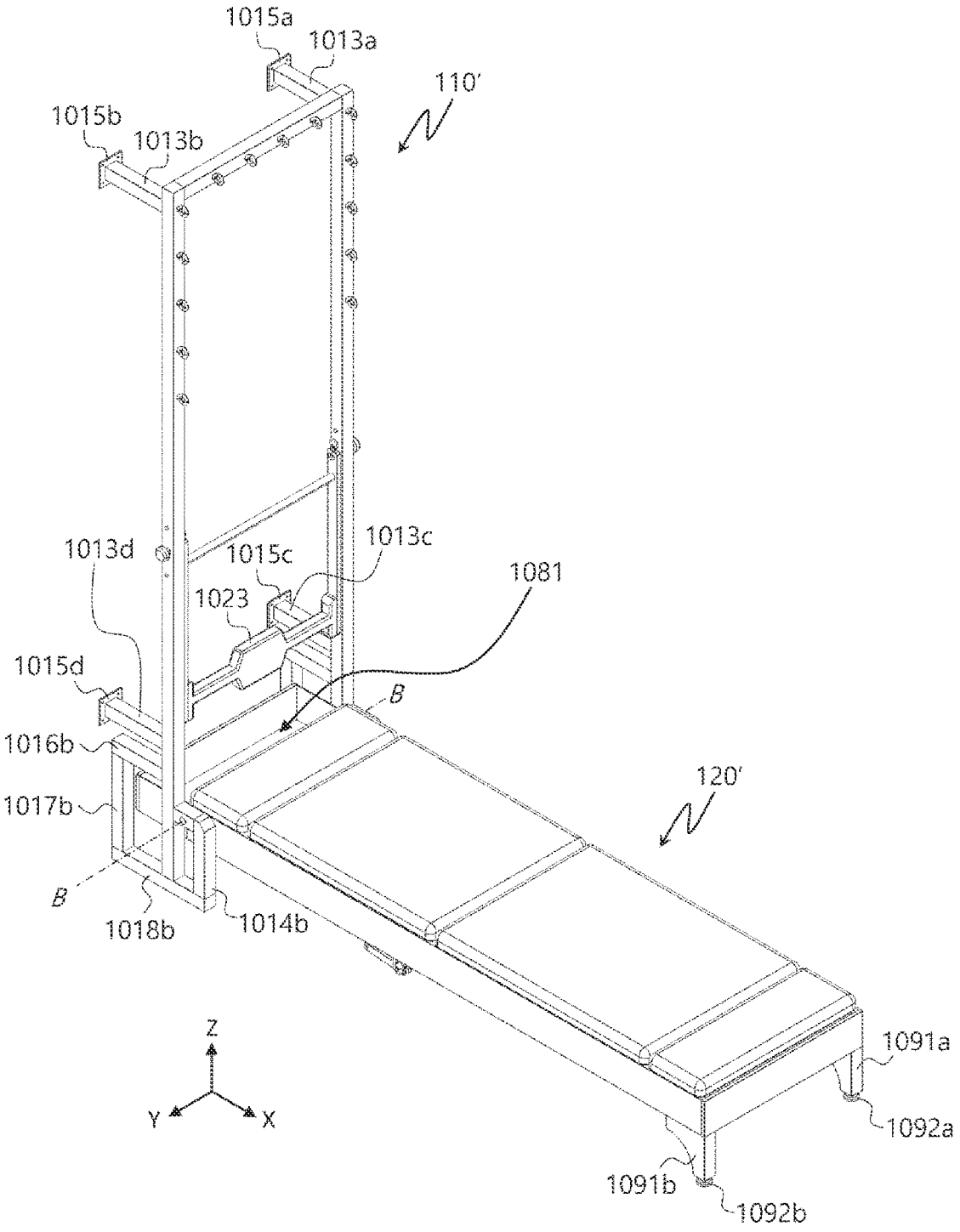
FIGS. 10A to 10C illustrate other structures of main bodies according to an embodiment of the present invention.
Figure 10B:
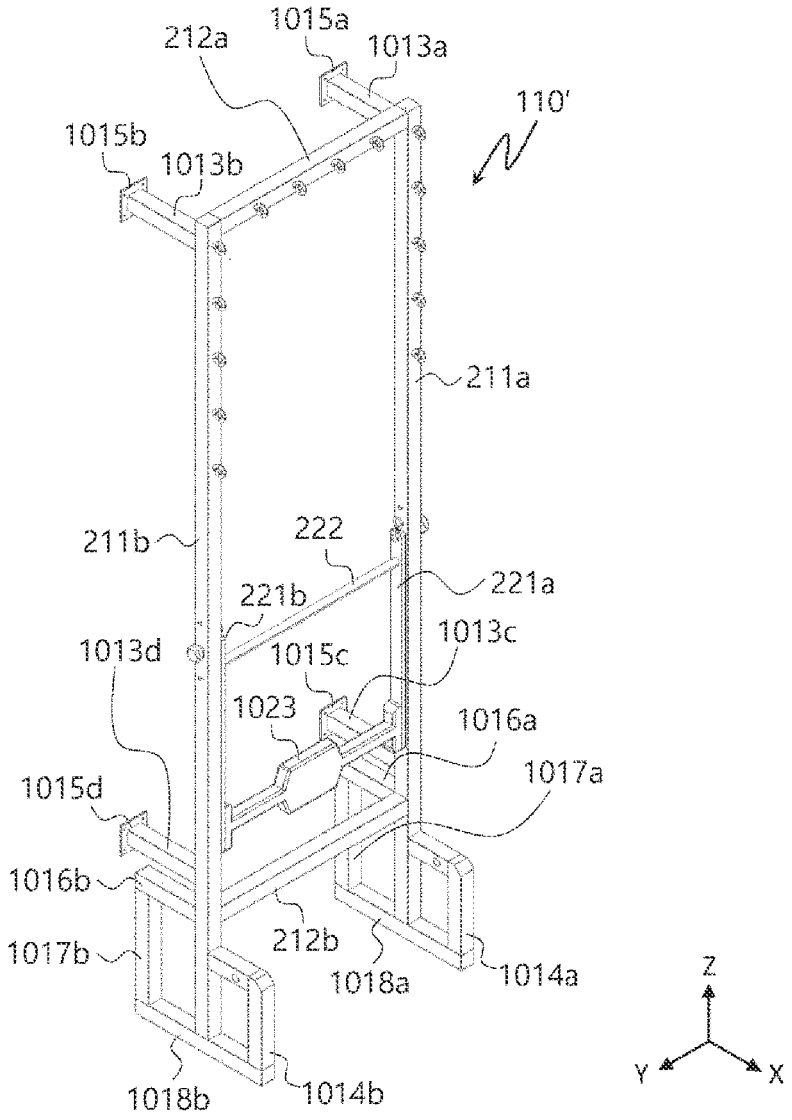
Figure 10C:
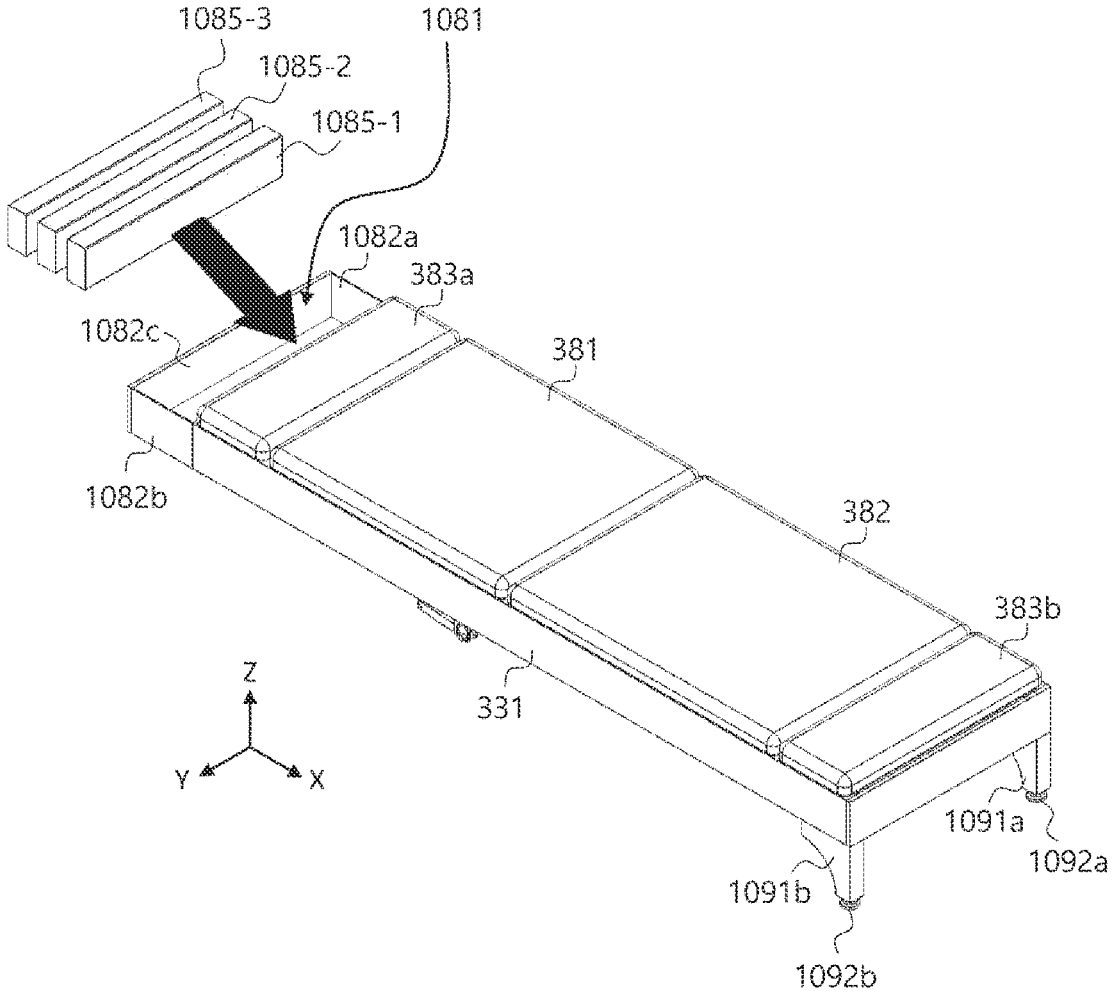

The structure of the exercise equipment according to an embodiment of the present invention has been described in detail above. At least a unit of the exercise equipment according to an embodiment of the present invention may be variously modified. For example, the transformation may be made to beautify the aesthetic of the exercise equipment. Alternatively, the deformation may be made for more convenient use of the exercise equipment. An example of the modification will be described with reference to FIGS. 10A through 10C. FIGS. 10A to 10C illustrate other structures of main bodies according to an embodiment of the present invention. The embodiment illustrated in FIGS. 10A to 10C will be described based on differences from the structure described above.

Referring to FIG. 10A, the exercise equipment includes a first body unit 110' and the second body unit 120'. The first main body unit 110' and the second body unit 120' are physically connected to each other, and the second body unit 120' may be rotated about an axis B-B parallel to the Y-axis.

Referring to FIG. 10B, the first body unit 110' includes a plurality of frames, similar to the first body unit 110 illustrated in FIG. 2. However, unlike the first body unit 110 illustrated in FIG. 2, the first body unit 110' does not include the fifth frame 213*a*, the sixth frame 213*b*, the seventh frame 213*c*, and the eighth frame 213*d*, and instead, includes mounting frames 1013*a*, 1013*b*, 1013*c*, and 1013*d*.

The mounting frames 1013*a*, 1013*b*, 1013*c*, and 1013*d* have a protruding shape to be perpendicular to a rectangular frame formed by the first frame 211*a*, the second frame 211*b*, the third frame 212*a*, and the fourth frame 212*b*. The mounting frames 1013*a*, 1013*b*, 1013*c*, and 1013*d* protrude in the same direction, and the brackets 1015*a*, 1015*b*, 1015*c*, and 1015*d* are respectively coupled to ends of the mounting frames 1013*a*, 1013*b*, 1013*c*, and 1013*d*. A plurality of holes may be formed in each of the brackets 1015*a*, 1015*b*, 1015*c*, and 1015*d*, and the exercise equipment may be fixed to a wall or the like through a nail or the like using the holes.

Also, similar to the first body unit 110 illustrated in FIG. 2, the first body unit 110' includes a pair of rotation arms 221*a* and 221*b*, a rotation arm connection bar 222, and a rotation arm handle 1023. However, the rotary arm handle 1023 illustrated in FIG. 10A has a different shape from the rotary arm handle 223 illustrated in FIG. 2. In detail, the rotary arm handle 223 illustrated in FIG. 2 has a cylindrical shape having a uniform cross-sectional size, but the rotary arm handle 1023 illustrated in FIG. 10A has a structure in which the cross-sectional size of the center and both ends thereof is larger than the other parts.

Unlike the first body unit 110 shown in FIG. 2, the first body unit 110' includes an 11th frame 1014*a*, a 12th frame 1014*b*, a 13th frame 1016*a*, a 14th frame 1016*b*, a 15th frame 1017*a*, a 16th frame 1017*b*, a 17th frame 1018*a*, and an 18th frame 1018*b*. The 11th frame 1014*a*, the 12th frame 1014*b*, the 13th frame 1016*a*, the 14th frame 1016*b*, the 15th frame 1017*a*, the 16th frame 1017*b*, the 17th frame 1018*a*, and the 18th frame 1018*b* form a structure of a lower part of the first body unit 110'.

In detail, the 18th frame 1018*b* is vertically connected to one end of the lower part of the second frame 211*b* and is in contact with the bottom. The 12th frame 1014*b* and the 16th frame 1017*b* are vertically connected to a surface opposite to the surface in contact with the bottom of the 18th frame 1018*b*. One end of the 12th frame 1014*b* is connected to the 18th frame 1018*b*, and the other end of the 12th frame 1014*b* is connected to the 12th frame 1014*b*. The 12th frame 1014*b* may have a structure similar to the 10th frame 214*b*, but may have a longer distance from the Z-axis and the X-axis than the 10th frame 214*b*. One end of the 16th frame 1017*b* is connected to the 18th frame 1018*b*, and the other end of the 16th frame 1017*b* is connected to the 14th frame 1016*b*. The fourteenth frame 1016*b* is connected to the second frame 211*b*. As described above, the 12th frame 1014*b*, the 14th frame 1016*b*, the 16th frame 1017*b*, and the 18th frame 1018*b* form a predetermined structure at a lower end of the second frame 211*b* of the first body unit 110'. Similarly, the 11th frame 1014*a*, the 13th frame 1016*a*, the 15th frame 1017*a*, and the 17th frame 1018*a* form a structure symmetrical to the 12th frame 1014*b*, the 14th frame 1016*b*, the 16th frame 1017*b*, and the 18th frame 1018*b* at the lower end of the first frame 211*a*.

Similar to the second body unit 120 illustrated in FIGS. 3A to 3D, the second body unit 120' includes an border frame 311 and a plurality of cushion units 381, 382, 383*a*, and 383*b*. However, unlike the second body unit 120 illustrated in FIGS. 3A to 3D, the second body unit 120' does not include the lower surface handles 331*a* and 331*b* and the side surface handles 332*a* and 332*b*, but instead includes the first leg member 1091*a* and the second leg member 1091*b* having a shape that narrows toward the bottom. The first leg member 1091*a* and the second leg member 1091*b* are disposed at corners of a lower surface of the border frame 311, and the first pad member 1092*a* and the second pad member 1092*b* are coupled to bottom surfaces of the first leg member 1091*a* and the second leg member 1091*b*, respectively.

Unlike the second body unit 120 shown in FIGS. 3A to 3D, the second body unit 120' includes a weight insertion space 1081 for adjusting the center of gravity of the second body unit 120'. The weight insertion space 1081 is formed by extending from one surface of the border frame 311, for example, a surface opposite to a direction in which the first leg member 1091*a* and the second leg member 1091*b* are disposed. In other words, the weight insertion space 1081 is a space extending one surface of the border frame 311 facing the bottom when the second body unit 120' is folded. Accordingly, on the X axis, the weight insertion space 1081 is disposed at a position further in the −direction than the axis B-B. That is, when the second main body 120' is folded, the weight insertion space 1081 is disposed below, in other words, closer to the floor than the axis B-B connecting the connecting shafts 313*a* and 313*b*. Accordingly, when at least one weight is inserted into the weight insertion space 1081, the center of gravity of the second body 120 moves in the X-axis direction.

Specifically, referring to FIG. 10C, the weight insertion space 1081 is a space surrounded by a plurality of wall surfaces 1082*a*, 1082*b*, and 1082*c*, and may accommodate a plurality of weights 1085-1 to 1085-3. The user may insert at least one of the weights 1085-1 to 1085-3 into the weight insertion space 1081 as needed. When at least one of the weights 1085-1 to 1085-3 is accommodated in the weight insertion space 1081, the center of gravity of the second body 120' moves in the −direction of the X axis. Accordingly, when the exercise equipment is changed from the unfolded state to the folded state, the magnitude of force required to lift the second body unit 120' may be reduced. That is, the weight insertion space 1081 is a component designed to lift the second body unit 120' with less force.

In the above-described embodiment, the weight insertion space 1081 has been described as an additional component separate from the border frame 311. However, the weight insertion space 1081 may be understood as a part of the border frame 311. That is, the wall surfaces 1082*a*, 1082*b* and 1082*c* forming the weight insertion space 1081 may be a part of the border frame 311. Also, in FIGS. 10A to 10C, the weight insertion space 1081 is expressed in a state in which an upper side thereof is open. However, in order to prevent the weight from being separated, a cover may be further disposed on the upper side of the weight insertion space 1081. In addition, in order to more stably fix the stored weights, members for fixing the weights may be further installed in the weight insertion space 1081.

When the weight insertion space 1081 described with reference to FIG. 10C is used, when the state of the exercise equipment is changed, particularly, when the state is changed from the unfolded state to the folded state, the second body unit 120 may be lifted with easily a small force. However, depending on the weight insertion space 1081 and the weight of the inserted weights, the second body unit 120 may rapidly rotate at the moment when the center of gravity of the second body unit 120 exceeds the axis B-B, which may injure a user who contacts or is adjacent to the second body unit 120 in order to move the second body unit 120.

To prevent this, at least one shock absorber (not shown) may be installed between the first main body 110 and the weight insertion space 1081. Rapid rotation of the second body section 120 is prevented by the at least one shock absorber, and thus it is possible to improve safety of the user. The specific installation position of the at least one shock absorber may be variously selected. For example, one end of the at least one shock absorber may be fixed to the outer surface of the wall surface 382*c* as the outer surface of the weight insertion space 1081, and the other end of the at least one shock absorber may be fixed to one of the first frame

211*a*, the second frame 211*b*, the 13th frame 1016*a*, the 14th frame 1016*b*, the 15th frame 1017*a*, and the 16th frame 1017*b* of the first body 110.

Meanwhile, the detailed description of the present invention has been made with respect to a specific embodiment, but various modifications may be made without departing from the scope of the present invention. Therefore, the scope of the present invention should not be limited to the described embodiments, but should be defined by those equivalent to the following claims as well as the following claims.

The invention claimed is:

1. An exercise equipment comprising:

a first body unit including:

a first frame and a second frame configured to be disposed vertically on a ground and parallel to each other, a third frame and a fourth frame, each connecting the first frame to the second frame, a first connecting frame connected to the first frame; and a second connecting frame connected to the second frame; and a second body unit including:

a border frame including connection shafts inserted into a first hole defined in the first connecting frame and a second hole defined in the second connecting frame, respectively, and cushion units which are arranged on one side of the border frame, wherein the cushion units comprise a first cushion unit having a first length, a second cushion unit having the first length and detachable, and a third cushion unit having a second length, wherein the second body unit is capable to rotate between the ground and the first body unit by rotating about an axis penetrating the first hole and the second hole, the second body unit being configured to be in one of an unfolded state, in which a side surface thereof is parallel to the ground, and a folded state, in which the side surface is parallel to the first body unit, wherein the second body unit includes a moving frame disposed under the cushion units and movable along rails installed on an inner surface of the border frame, wherein the second body unit further includes:

a mirror disposed on another side of the border frame, the moving frame being disposed between the cushion units and the mirror and movable along the rails installed on the inner surface of the border frame;

fixing units installed at outside of the mirror to protrude in a front direction of the mirror on a surface on which the mirror is disposed;

supporting units connected to the fixing units; and a ballet barre handle connected between the supporting units and disposed on a front surface of the mirror, wherein the ballet barre handle rotates about the fixing units; and at least one first elastic member disposed in both the moving frame and the border frame, wherein the moving frame includes two parallel side walls, and guide members are disposed on the two parallel side walls of the moving frame and contacting inner surfaces of the rails to assist the moving frame to move along the rails, wherein the moving frame is coupled to the first cushion unit, and when the first cushion unit is moved toward a space from which the second cushion unit is removed in a state in which the second cushion unit is removed, the moving frame is configured to be moved together with the first cushion unit along the rails, wherein the at least one first elastic member is configured to resist movement of the moving frame, wherein the moving frame further includes: an inner wall vertically extending between the two parallel side walls, a first hook set disposed on a first surface of the inner wall, and a second hook set disposed on a second surface of the inner wall, which is opposite to the first surface, wherein the border frame further includes: a third hook set disposed on a first inner side surface of the border frame perpendicular to the rails and facing the first surface, and a fourth hook set disposed on a second inner side surface of the border frame perpendicular to the rails and facing the second surface, wherein the at least one first elastic member is configured to resist movement of the moving frame away from the first inner side surface, when the at least one first elastic member is assembled between the first hook set and the third hook set, and wherein the at least one first elastic member is configured to resist movement of the moving frame away from the second inner side surface, when the at least one first elastic member is assembled between the second hook set and the fourth hook set.

2. The exercise equipment of claim 1, wherein the first body unit further includes:

a fifth frame and a sixth frame vertically connected to the first frame in a direction opposite to a direction from the first frame toward the second body unit; and a seventh frame and an eighth frame vertically connected to the second frame in a direction opposite to a direction from the second frame toward the second body unit, wherein the fifth frame, the sixth frame, the seventh frame, and the eighth frame have a same length.

3. The exercise equipment of claim 1, wherein the first body unit further includes:

a pair of rotation arms disposed on a surface of the first frame and a surface of the second frame, respectively, through connection members, the surface of the first frame and the surface of the second frame facing each other;

a rotation arm connection bar and a rotation arm handle connected to facing surfaces of the pair of rotation arms, respectively; and a fifth hook set including fifth hooks installed at two ends of each of the pair of rotation arms, respectively, wherein the pair of rotation arms, the rotation arm connection bar, and the rotation arm handle are configured to rotate about the connection members, and wherein, when at least one second elastic member is assembled to at least one of the fifth hooks and at least one of sixth hooks of a sixth hook set installed in the first body unit, the rotation arm handle is configured to be maintained in a state in which it the rotation arm handle is lifted to a front surface of the first body unit by being pulled by the at least one second elastic member.

* * * * *